US005258100A

United States Patent [19]

Niskanen et al.

[11] Patent Number: 5,258,100

[45] Date of Patent: Nov. 2, 1993

[54] MINIMIZING GAS SEPARATION IN A MIXER OUTLET

[75] Inventors: Toivo Niskanen, Karhula, Finland; Brian F. Greenwood, Glens Falls, N.Y.; Kari Peltonen, Karhula, Finland; Stephen J. Dunn, Glens Falls, N.Y.; Mika P. Makela, Karhula, Finland

[73] Assignee: Kamyr, Inc., Glens Falls, N.Y.

[21] Appl. No.: 842,326

[22] Filed: Feb. 28, 1992

[51] Int. Cl.[5] ..... D21C 3/00

[52] U.S. Cl. ..... 162/57; 162/243

[58] Field of Search ..... 162/57, 235, 236, 234, 162/243, 261; 366/184, 196, 345, 51; 415/182.1, 203, 206

[56] References Cited

U.S. PATENT DOCUMENTS

| | | | |
|---|---|---|---|
| 3,758,227 | 9/1973 | Pollak | 415/212.1 |
| 4,093,506 | 6/1978 | Richter . | |
| 4,339,206 | 7/1982 | Ahs | 366/307 |
| 4,410,337 | 10/1983 | Gullichsen | 55/21 |
| 4,518,311 | 5/1985 | Dernedde et al. | 415/206 |
| 4,789,301 | 12/1988 | Osborne et al. | 415/212.1 |

FOREIGN PATENT DOCUMENTS

| | | |
|---|---|---|
| 406868A2 | 1/1991 | European Pat. Off. . |
| 823279 | 9/1982 | Finland . |
| 854105 | 10/1985 | Finland . |
| WO85/04932 | 4/1985 | PCT Int'l Appl. . |

OTHER PUBLICATIONS

International Technology Disclosure, vol. 1 No. 9 (Jul. 25, 1983) pp. 3-4.

Berry, R., "High-Intensity Mixers in Chlorination and Chlorine Dioxides Stages: Survey Results and Evaluation", Pulp and Paper Canada, vol. 91 No. 4 (1990), pp. T151-T160.

Brochure entitled "Kamyr Mc® Mixer", Jan. 1988.

*Primary Examiner*—W. Gary Jones
*Assistant Examiner*—Brenda Lamb
*Attorney, Agent, or Firm*—Nixon & Vanderhye

[57] ABSTRACT

A method and mixer are provided for mixing chemical (such as a gas like chlorine or oxygen) with a slurry (such as paper pulp having a consistency of about 1-16%) in such a way that separation of gas from the slurry at the discharge from the mixer is avoided. Where the mixer housing has a radial discharge, the leading and trailing walls of the discharge (in the direction of circular and tangential movement of slurry within the main body housing of the mixer) present curved configurations to transition the slurry from circular/tangential movement to radial movement. The curvature of the configurations (which may be provided by inserts) does not exceed an angle of about 10 degrees at any point along them until radial flow is established. Alternatively, the discharge may allow the tangential movement of the pulp in the main housing to continue by cutting off the original radial pulp discharge outlet, and welding or otherwise attaching a retrofit new discharge outlet to the main housing body similar to a pump volute with a gradually increasing cross-section.

12 Claims, 3 Drawing Sheets

FIG. 3
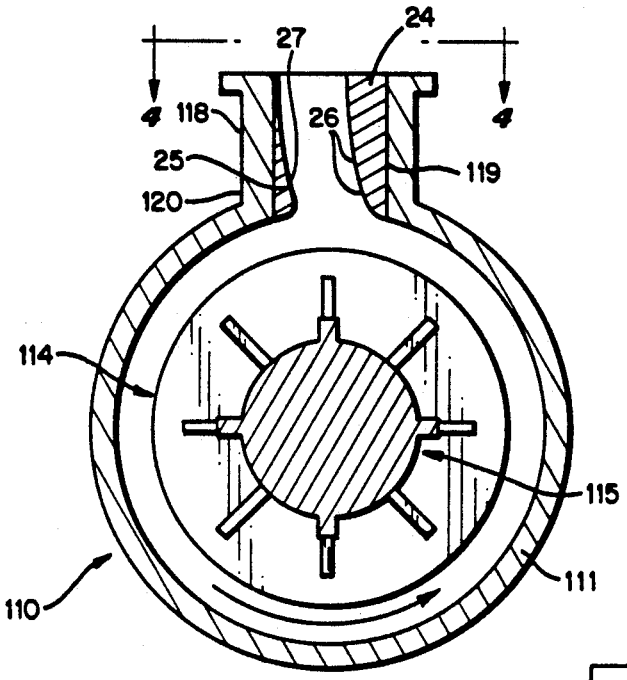
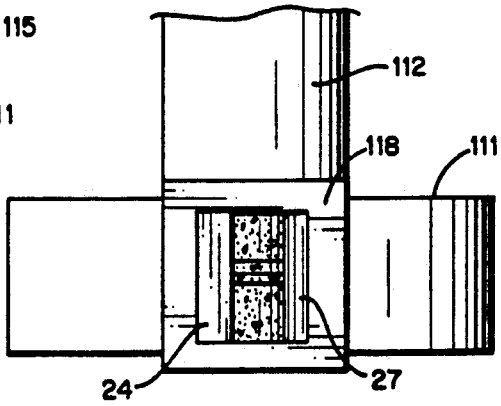
FIG. 4a
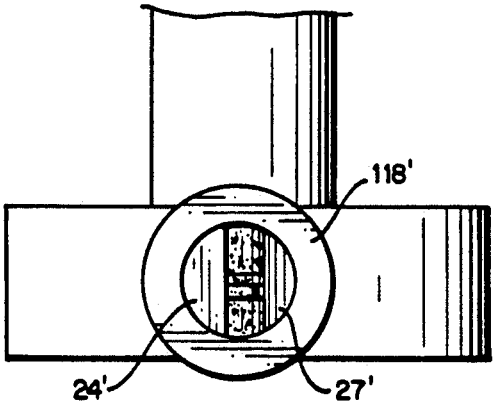
FIG. 4b

MINIMIZING GAS SEPARATION IN A MIXER OUTLET

BACKGROUND AND SUMMARY OF THE INVENTION

Conventional mixers for mixing chemicals (typically in gaseous form) in slurries, such as the MC® mixer sold by Kamyr, Inc. of Glens Falls, N.Y. and the "Ahlmixer" TM sold by Ahlstrom Machinery of Roswell, Ga. are utilized for mixing chlorine, chlorine dioxide, oxygen, and like chemicals, in liquid and/or gaseous form, into paper pulp slurries having consistencies ranging anywhere from about 1 to 16%. These mixers typically have a housing with a main hollow body portion with a generally circular cross-section and a rotatable impeller disposed in the hollow body portion for imparting a circular and tangential force to the slurry within it, as part of the mixing action for intimately mixing the slurry (pulp) and chemical. The mixed slurry is then discharged through a radial discharge outlet in the main body portion of the housing. These mixers are very successful in accomplishing their desired end results.

In prior art mixers for mixing chemicals in slurries, particularly in the pulp and paper field, the slurry often has substantial amounts of gas within it. Of course the gas content is significantly increased during mixing if the chemical being mixed with the slurry is in gaseous form. Therefore, under some circumstances there is separation of gas at the discharge outlet due to the abrupt transition from circular and tangential flow in the main housing portion to radial flow in the radial discharge outlet. Of course the gas separation, if it occurs, tends to reduce mixing efficiency, and can also serve as an impediment to uniform flow of the mixed slurry out of the discharge outlet. Under these conditions, a gas bubble typically forms adjacent the leading wall (in the direction of circular movement of slurry within the main body portion of the housing) which extends a significant distance into the discharge outlet.

According to the present invention, methods of mixing a chemical with the slurry are provided which effect discharge of the mixed chemical and slurry from the main body portion of the housing without significant separation of gas from the slurry under any conditions, and a mixer is provided which achieves these results.

According to one aspect of the present invention, a method of mixing chemical with slurry, having gas present in the slurry (which may be inherent in the slurry, and/or may be as a result of the gaseous form of the introduced chemical), using a mixer housing having a main hollow body portion with a generally circular cross-section and radial discharge for mixed slurry/-chemical, is provided. The method comprises the following steps: (a) Introducing the slurry and chemical separately into the mixer. (b) Acting upon the slurry and chemical in the mixer to mechanically intimately intermix them, including by moving the slurry and chemical together in a circular and tangential path in the main body portion of the mixer. And, (c) discharging the mixed chemical and slurry from the main body portion through the radial discharge without significant separation of gas from the slurry by minimizing the transition of the mixed chemical and slurry from its circular and tangential path in the body portion to a radial path in the radial discharge.

Step (c) is typically practiced by shaping the leading (in the direction of circular movement of slurry within the body portion) wall of the radial discharge so that it presents a curved configuration to the slurry entering the discharge. The curvature of the curved configuration cannot exceed an angle of about 10 degrees at any point along it until radial flow is established. This thus provides a smooth transition from circular/tangential flow to radial flow. This smooth transition may be further enhanced by providing a curved configuration at the trailing wall too which substantially parallels the contour of the leading wall, again having a curvature which does not exceed an angle of about 10 degrees at any point along it, until radial flow is established. The shaping of the walls may be accomplished by providing inserts, which inserts approximate the configuration of a gas bubble that would normally form in the radial outlet, and a dead space opposite the gas bubble.

The invention also comprises a mixer which has the features recited above. That is the mixer includes as a distinguishing component from the prior art, means associated with the radial discharge for minimizing the transition of the mixed chemical and slurry from its circular and tangential path in the main body portion to a radial path in the radial discharge, so that no substantial separation of gas from slurry in the discharge takes place. The transition minimizing means preferably comprises means defining the shape of the leading wall of the radial discharge so that it presents a curved configuration to the slurry entering the discharge, in which the curvature of the configuration does not exceed an angle of about 10 degrees at any point along it until the radial flow is established. The transition means also comprises a parallel curvature of the trailing wall of the radial discharge. These configurations may be provided by inserts which preferably are of a material compatible with the discharge outlet, and consistent with process conditions (e.g. stainless steel, carbon steel, titanium, Hastelloy, etc.). The configuration of the outlet may be circular, quadrate, or a transition from quadrate to circular.

According to another aspect of the present invention, prevention of significant gas separation at the discharge from a mixer having a radial outlet is accomplished in another way. According to this aspect of the invention, the existing radial discharge outlet is removed and retrofit with one that it is substantially tangential, similar to a pump volute, with a gradually increasing cross-section By tangentially discharging the mixed chemical and slurry from the body portion of the mixer through the discharge, again the slurry does not change direction precipitously, so that substantial separation of gas from the slurry at the discharge is avoided, even if the chemical mixed with the slurry is introduced into the mixer in gaseous form.

It is the primary object of the present invention to minimize gas separation at the discharge outlet of a mixer for mixing slurry and chemical. This and other objects of the invention will become clear from an inspection of the detailed description of the invention and from the appended claims.

BRIEF DESCRIPTION OF THE DRAWINGS

FIG. 3 is a view like that of FIG. 2 of a first embodiment of a mixer according to the present invention;

FIG. 4*a* is an end view, as seen at arrows 4—4 of FIG. 3, of one form of outlet of the mixer of FIG. 3, and FIG. 4*b* is a view like that of FIG. 4*a* of another outlet configuration.

DETAILED DESCRIPTION OF THE DRAWINGS

Figure 1:
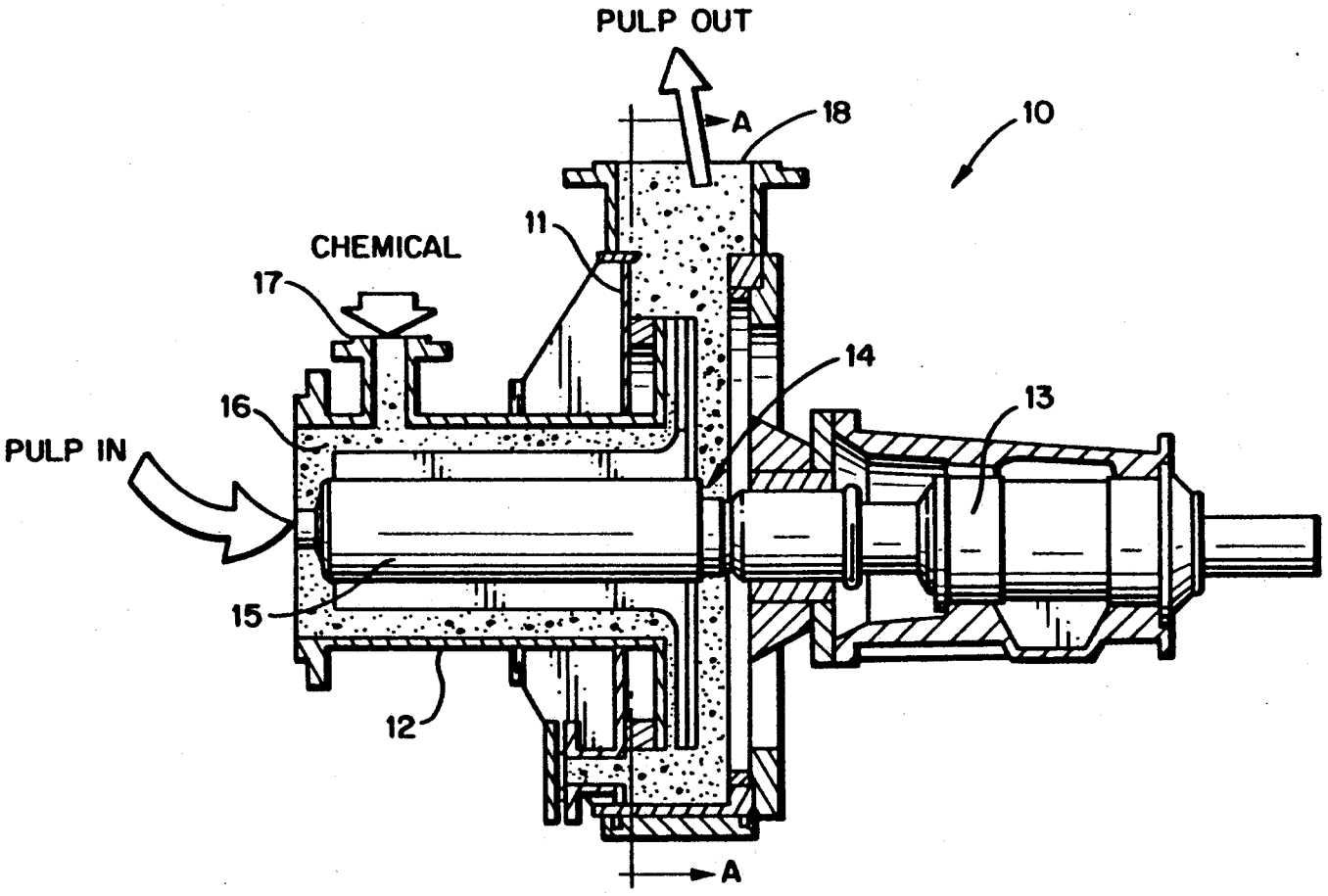
FIG. 1 (PRIOR ART)
FIG. 1 is a side cross-sectional schematic view, partly in elevation, illustrating a conventional mixer that may be modified according to the invention, to practice the methods of mixing chemical with slurry according to the invention.
Figure 2:
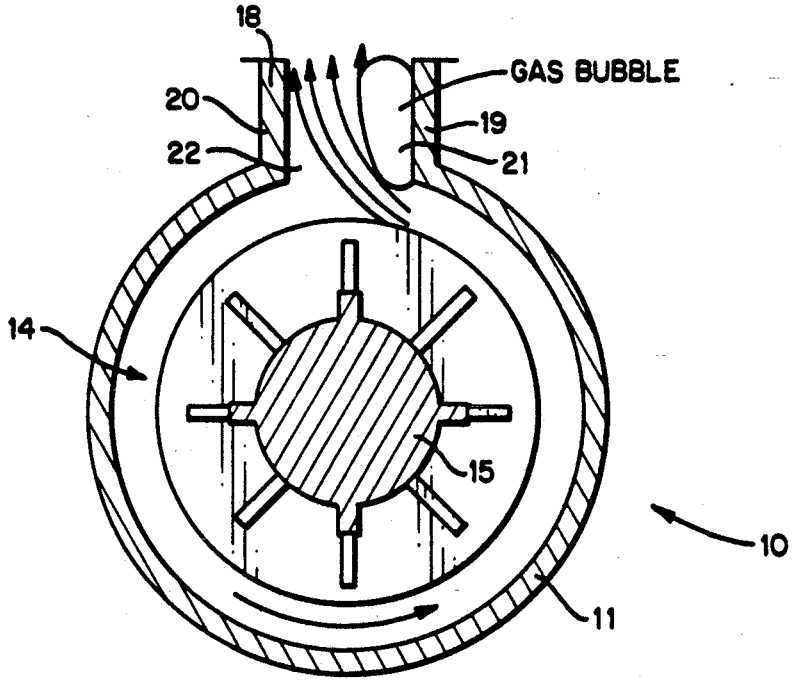
FIG. 2 (PRIOR ART)
FIG. 2 is a schematic longitudinal cross-sectional view of a prior art version of the mixer of FIG. 1 taken along lines A—A thereof showing the formation of a gas bubble.

The mixture 10 illustrated in FIGS. 1 and 2 is representative of the conventional MC® mixer sold by Kamyr, Inc. of Glens Falls, N.Y., which has proven to successfully perform mixing functions under a wide variety of circumstances, and pulp consistencies. While such a mixer will be illustrated in the drawings, it is to be understood that this is merely exemplary, and the invention is applicable to a wide variety of mixers for mixing pulp with chemical (particularly in gaseous form), including the "Ahlmixer" TM mixer sold by Ahlstrom Machinery of Roswell, Ga.

The mixer 10 includes a housing having a main hollow body portion 11 with a generally circular cross-section, and an elongated tubular portion 12 substantially concentric with the portion 11 and elongated axially from the portion 11. Mounted within the housing portion 11 is an impeller 14, typically in the form of a disc with ribs on it, and in the case of the MC® mixer rotated by a motor 13 at such a high speed that it fluidizes medium consistency (e.g. about 6–18% solids) pulp. Within the housing portion 12 is an axial extension 15 of the impeller 14.

Pulp is introduced into pulp inlet 16, while chemical to be mixed with the pulp is introduced into inlet 17. While both of these inlets 16, 17 are shown in the housing portion 12, they could be arranged differently; for example the chemical could be introduced into the housing portion 11. The chemical introduced in inlet 17 may be any conventional chemical for treating pulp, or other slurries, such as chlorine, chlorine dioxide, oxygen, etc., which may be in liquid and/or gaseous form, but typically is at least partially in gaseous form. The intimately mixed pulp and chemical are then discharged through discharge outlet 18, which is typically a radial outlet.

As seen from the prior art mixer 10 in FIG. 2, the mixed pulp in the housing portion 11 is moved in a circular and tangential path, as indicated by the directional arrow, until it reaches the leading wall 19 of the outlet 18 (the wall 19 "leading" in the direction of rotation/circular movement of the pulp within the housing portion 11). Because of an abrupt change at the leading wall 19, the pulp moves from a circular/tangential path to a substantially radial path. This abrupt change may cause at least some gas to separate from the pulp, the volume of gas separating perhaps being significant enough to affect mixing efficiency, especially when a gaseous treatment chemical has been introduced at the inlet 17. Adjacent the leading wall 19, and opposite the trailing wall 20, a gas bubble 21 may form, and a dead space 22 forms at the intersection of the trailing wall 20 with the housing portion 11. This gas bubble 21 may mean less mixing efficiency, and can interfere with the proper throughput of pulp in the discharge 18.

According to the embodiment of the invention illustrated in FIGS. 3, 4*a*, and 4*b*, the problem of gas separation has substantially been solved. In the embodiment of FIGS. 3 and 4*a*, 4*b*, components comparable to those in the FIGS. 1 and 2 prior art construction are shown by the same reference numeral only preceded by a "1".

In the FIGS. 3, 4*a* and 4*b* embodiment, the impeller 114 moves the pulp and chemical in the housing main body portion 111 (the rest of the structure 110 being the same as in the prior art structure of FIG. 1), and means 24 and 25 are associated with the radial discharge 118 for minimizing the transition of mixed chemical and slurry from its circular and tangential path in the housing main body portion 111 to a radial path in the radial discharge 118, so that no substantial separation of gas from slurry takes place in the discharge outlet 118. The transition minimizing means/element 24 comprises means defining the shape of the interior of the leading wall 119 so that it presents a curved configuration 26 to the slurry entering the discharge 118. The curvature of the configuration 26 is such that it does not exceed an angle of about 10 degrees at any point therealong until radial flow is established, the about 10 degrees or less angle ensuring smooth transitional flow. Also, the transition minimizing means/element 25 comprises a similar curved configuration 27 providing the interior of the trailing wall 120 of the discharge 118 which substantially parallels the curved configuration 26, and again has a curvature that does not exceed an angle of about 10 degrees at any point along it until radial flow is established.

From a comparison of FIGS. 2 and 3, it will be seen that the means/elements 24, 25 essentially fill in the volumes occupied by the gas bubble 21 and dead space 22 in the prior art configuration of FIG. 2. The means/elements 24, 25 preferably are in the form of inserts which are welded, or otherwise affixed, to the interior walls 119, 120 of the discharge 118, although they could be cast as part of the mixer 110. The material of which the means/elements 24, 25 are constructed may be any material compatible with the housing 111 and discharge 118, and the process conditions for the mixer, such as stainless steel, carbon steel, titanium, and Hastelloy.

As shown in FIG. 4*a*, the discharge 118 can have a quadrate configuration. This quadrate configuration can, downstream, taper/transition to a circular configuration. Alternatively, as illustrated for the discharge 118′ in FIG. 4*b*, the discharge may have a circular configuration, the element 24′ and the surface 27′ being illustrated in FIG. 4*b* with the circular discharge 118′.

Utilizing the apparatus of FIGS. 3, 4*a*, and/or 4*b*, a method of mixing chemicals with a slurry having gas intermixed therewith is provided. The slurry may have a consistency from about 1% to about 16%. If an MC® mixer, such as illustrated in the drawings, or an Ahlmixer TM, is utilized, then the consistency of the slurry will typically be about 6–16%, only such mixers can also be utilized with pulp having a consistency in the range of about 1–5%. Of course a wide variety of other mixers also may be utilized.

The method according to the invention comprises the steps of introducing the slurry and chemical separately into the mixer 110 (e.g. in structures the same as, or comparable to, the inlets 16, 17 for the prior art mixer 10 of FIG. 1); acting on the slurry and chemical in the mixer 110 to mechanically intimately intermix them, including by moving the slurry and chemical together in a circular and tangential path in the body portion 111 of the mixer 110 (utilizing impeller 114); and discharging the mixed chemical and slurry from the body portion 111 through the radial discharge 118 without significant separation of gas from the slurry by minimizing the transition of the mixed chemical and slurry from a circular and tangential path in the body portion 111 to a radial path in the radial discharge 118. This is accomplished by shaping the leading wall 119 of the radial discharge 118 so that it presents a curved configuration 26 in which the curvature does not exceed an angle of about 10 degrees at any point along it until radial flow is established, and also by preferably providing a parallel curvature configuration 27 associated with the trailing wall 120 of the discharge outlet 118. The pulp/chemical mixture discharged from the discharge 118 has essentially no gas separation, there being no tendency for the gas to separate since the transition is gradual, and there being no volume for the gas to occupy since substantially the entire discharge 118 is flow path.

Figure 5:
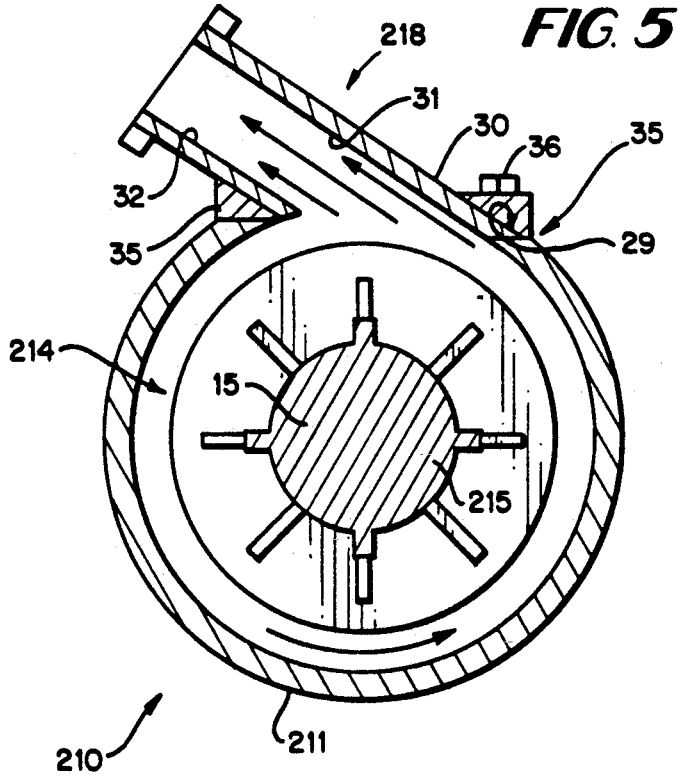
FIG. 5 is a view like that of FIGS. 2 and 3 for a second embodiment of mixer according to the invention, retrofit with a tangential outlet.

An alternative configuration for minimizing separation of gas at the pump discharge outlet of a radial outlet mixer is provided in the embodiment of FIG. 5. In this embodiment structures comparable to those in the prior art configuration of FIGS. 1 and 2 are illustrated by the same reference numerals only preceded by a "2".

Note that in the mixer 210, the radial discharge outlet, like that of FIG. 2, has been cut off (e.g. with a torch, appropriate saw, or the like), so that it has a flat surface 29 for receipt of a new discharge outlet. Then, a new discharge outlet 218, which is not radial, but is designed similarly to a pump volute, with a gradually increasing cross-section, is retrofit in place of the radial outlet, being placed flush against the surface 29. The wall portion 30 of the discharge outlet 218 which is retrofit to the housing main body 211 has a tangential orientation, the inner wall 31 thereof providing a continuous substantially linear pathway for the pulp/chemical mixture as it moves into the discharge 218, continuing in the same circular/tangential path. Also, because of the spacing between the interior wall portions 31, 32, the cross-section of discharge available to the pulp gradually increases, again ensuring a smooth movement of the pulp so that it does not change direction precipitously, so that substantial separation of gas from the slurry at the discharge 218 is avoided.

The discharge 218 may be circular in cross section, or quadrate in cross-section, and ultimately transitioning to a circular cross-sectional configuration. The discharge outlet 218 may be held in place on the main body 211 by welding 35 (FIG. 5), or it may be bolted in place (see bolt 36), and a sealant provided between the discharge 218 and the housing main body 211 to which it is retrofit.

In using the mixer 210 of FIG. 5, one tangentially discharges the mixed chemical and slurry from the body portion 211 (between tangential wall surfaces 31, 32) so that the slurry does not change direction precipitously, and so that substantial separation of gas from the slurry at the discharge 218 is avoided.

It will thus be seen that according to the present invention, advantageous methods of mixing chemical with slurry to prevent significant separation of gas from the slurry at the mixer discharge are provided, as well as a mixer for accomplishing that result. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A method of mixing chemical with slurry, the slurry having gas therein, using a mixer housing having a main hollow body portion with a generally circular cross-section and a straight radial discharge for mixed slurry/chemical, comprising the steps of:

(a) introducing the slurry and chemical separately into the mixer;

(b) acting upon the slurry and chemical in the mixer to mechanically intimately intermix them, including by moving the slurry and chemical together in a circular and tangential path in the body portion of the mixer; and (c) discharging the mixed chemical and slurry from the body portion through the radial discharge without significant separation of gas from the slurry by minimizing the transition of the mixed chemical and slurry from its circular and tangential path in the body portion to a radial path in the radial discharge, by shaping the interior of the leading, in the direction of circular movement of slurry within the body portion, wall of the straight radial discharge so that it presents a curved configuration to the slurry entering the radial discharge in which the curvature of the configuration does not exceed an angle of about 10° at any point therealong until radial flow is established.

2. A method as recited in claim 1 wherein step (c) is further practiced by shaping the interior trailing wall of the radial discharge so that it presents a curved configuration to the slurry which is substantially parallel to the curved configuration of the leading wall, and in which the curvature of the configuration does not exceed an angle of about 10 degrees at any point therealong until radial flow is established

3. A method as recited in claim 2 wherein step (a) is practiced by introducing the chemical in gaseous form.

4. A method as recited in claim 3 wherein the slurry is paper pulp having a consistency of about 6 to 16%, and wherein step (b) is practiced in part by fluidizing the slurry and chemical.

5. A method as recited in claim 3 wherein the slurry is paper pulp having a consistency of about 1 to 16%.

6. A method as recited in claim 2 wherein step (c) is further practiced by structuring and arranging insert bodies in the radial discharge to shape the leading and trailing walls of the radial discharge.

7.-A method as recited in claim 1 wherein step (a) is practiced by introducing the chemical in gaseous form.

8. A method as recited in claim 1 wherein the slurry is paper pulp having a consistency of about 6 to 16%, and wherein step (b) is practiced in part by fluidizing the slurry and chemical.

9. A method as recited in claim 1 wherein the slurry is paper pulp having a consistency of about 1 to 16%.

10. A method as recited in claim 2 wherein the slurry is paper pulp having a consistency of about 6 to 16%, and wherein step (b) is practiced in part by fluidizing the slurry and chemical.

11. A method as recited in claim 6 wherein step (a) is practiced by introducing the chemical in gaseous form.

12. A method as recited in claim 6 wherein the slurry is paper pulp having a consistency of about 6 to 16%, and wherein step (b) is practiced in part by fluidizing the slurry and chemical.

* * * * *